US010184335B2

(12) United States Patent
Lee et al.

(10) Patent No.: US 10,184,335 B2
(45) Date of Patent: Jan. 22, 2019

(54) SINGLE PACKERS INLET CONFIGURATIONS

(71) Applicant: Schlumberger Technology Corporation, Sugar Land, TX (US)

(72) Inventors: Ryan Sangjun Lee, Sugar Land, TX (US); Yong Chang, Sugar Land, TX (US); Ashers Partouche, Richmond, TX (US); Sylvain Bedouet, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 475 days.

(21) Appl. No.: 14/106,540

(22) Filed: Dec. 13, 2013

(65) Prior Publication Data

US 2015/0167457 A1 Jun. 18, 2015

(51) Int. Cl.
*E21B 49/08* (2006.01)
*E21B 47/12* (2012.01)

(52) U.S. Cl.
CPC ..... *E21B 49/081* (2013.01); *E21B 47/124* (2013.01)

(58) Field of Classification Search
USPC ..... 166/179, 187; 73/152.55, 152.36, 73/152.23–152.28
See application file for complete search history.

(56) References Cited

U.S. PATENT DOCUMENTS 6,174,001 B1 1/2001 Enderle
2008/0156487 A1* 7/2008 Zazovsky ..... E21B 49/10 166/264
2009/0308604 A1* 12/2009 Corre ..... E21B 33/1243 166/250.17
2010/0071898 A1* 3/2010 Corre ..... E21B 33/12 166/264
2011/0272150 A1* 11/2011 Ives ..... E21B 49/10 166/264

OTHER PUBLICATIONS

Bunn, et al. "Design, Implementation, and Interpretation of a "Three-Dimensional Well Test" in the Cormorant Field, North Sea," SPE 15858, Oct. 1986, 10 pages.
Bunn, et al. "Distributed Pressure Measurements Allow Early Quantification of Reservoir Dynamics in the Jene Field," SPE 17682, Mar. 1991, pp. 55-62.
Kaneda, et al. "Interpretation of a Pulse Test in a Layered Reservoir," SPE 21337, SPE Formation Evaluation, Dec. 1991, pp. 453-462.

(Continued)

*Primary Examiner* — Taras P Bemko
(74) *Attorney, Agent, or Firm* — Michael Dae

(57) ABSTRACT

A configuration for testing fluid with a single packer includes at least one sample inlet and at least one guard inlet surrounding a periphery of the at least one sample inlet, wherein the at least one sample inlet has at least one side that is parallel to another side of the at least one sample inlet and the at least one sample inlet has at least two rounded ends connecting each of the parallel sides, and the at least one guard inlet has at least one side that is parallel to another side of the at least one guard inlet and the at least one guard inlet has at least two rounded ends connecting each of the parallel side of the guard inlet.

4 Claims, 3 Drawing Sheets

(56) References Cited

OTHER PUBLICATIONS

Lasseter, et al. "Interpreting an RFT-Measured Pulse Test with a Three-Dimensional Simulator," SPE 14878,SPE Formation Evaluation, Mar. 1988, pp. 139-146.
Saeedi, et al. "Layer Pulse Testing Using a Wireline Formation Tester," SPE 16803, Sep. 1987, pp. 543-550.
Yaxley, et al. "A Field Example of Interference Testing Across a Partially Communicating Fault," SPE 19306, Society of Petroleum Engineers, 1989, 41 pages.

* cited by examiner

SINGLE PACKERS INLET CONFIGURATIONS

CROSS-REFERENCE TO RELATED APPLICATIONS

None.

FIELD OF THE INVENTION

Aspects relate to single packer configurations used for downhole oil and gas operations. More specifically, aspects relate to single packer configurations for inlet designs for the single packer and the construction of those inlet designs.

BACKGROUND INFORMATION

Testing formation fluids in downhole conditions can be a challenging endeavor that presents many problems for engineers and scientists. To aid in the testing of such formation fluids, different apparatus may be used to accomplish the testing, including probes and single packer apparatus. Single packer apparatus have many advantages compared to standard testing devices. Single packer apparatus may be used to separate different segments of the wellbore so testing may be performed at a variety of pressures, for example.

In order to separate the different segments of a wellbore, the single packer device is positioned downhole to a desired elevation. The single packer, during placement, is generally in a minimum diameter configuration. Once the single packer is at the desired elevation, the single packer is expanded such that outer diameter of the single packer contacts the inner diameter of the wellbore. The expansion may occur, for example, through actuation of an internal mandrel.

Expansion of the single packer can lead to significant problems, due to many issues. Environmental issues can cause stresses on different sections of the single packer system and thus, it would be desirable to eliminate such stresses. Additionally, inlet designs for the single packer can provide different results, therefore specifying the types of inlet designs is an important aspect for a single packer.

SUMMARY

The aspects described in this summary should not be considered limiting and provide only one description of ideas and concepts provided. An inlet for a single packer, having at least one sample inlet and at least one guard inlet surrounding the periphery of the at least one sample inlet, wherein the at least one sample inlet has at least one side that is parallel to another side of the at least one sample inlet and the at least one sample inlet has at least two rounded ends connecting each of the parallel sides, and the at least one guard inlet has at least one side that is parallel to another side of the at least one guard inlet and the at least one guard inlet has at least two rounded ends connecting each of the parallel side of the guard inlet.

In another embodiment, an inlet for a single packer is disclosed having at least one sample inlet and at least four guard inlets located separate from the at least one sample inlet around the periphery of the at least one sample inlet, wherein the at least one sample inlet has at least one side that is parallel to another side of the at least one sample inlet and the at least one sample inlet has at least two rounded ends connecting each of the parallel sides, and each of the at least four guard inlets located separate from the at least one sample inlet has at least one side that is parallel to another side of each guard inlet and each guard inlet at least two rounded ends connecting each of the parallel sides.

In another embodiment, an inlet for a single packer is disclosed having at least one sample inlet and at least two guard inlets located separate from the at least one sample inlet around the periphery of the at least one sample inlet, wherein the at least one sample inlet has at least one side that is parallel to another side of the at least one sample inlet and the at least one sample inlet has at least two rounded ends connecting each of the parallel sides, and each of the at least two guard inlets located separate from the at least one sample inlet has at least one side that is parallel to another side of each guard inlet and each guard inlet at least two rounded ends connecting each of the parallel sides.

In another embodiment, a packer is disclosed having a mandrel configured to move from a first unactuated position to a second actuated position, a body configured to expand from an unactuated position to a second expanded position, the expanded position occurring through actuation of the mandrel, at least one covering over the body, the covering with at least one inlet opening, wherein at least one inlet; wherein the at least one inlet is configured as at least one guard inlet surrounding the periphery of the at least one sample inlet, wherein the at least one sample inlet has at least one side that is parallel to another side of the at least one sample inlet and the at least one sample inlet has at least two rounded ends connecting each of the parallel sides, and the at least one guard inlet has at least one side that is parallel to another side of the at least one guard inlet and the at least one guard inlet has at least two rounded ends connecting each of the parallel side of the guard inlet.

In another embodiment, a packer, is disclosed having a mandrel configured to move from a first unactuated position to a second actuated position, a body configured to expand from an unactuated position to a second expanded position, the expanded position occurring through actuation of the mandrel; at least one covering over the body, the covering with inlets having at least one sample inlet; and at least four guard inlets located separate from the at least one sample inlet around the periphery of the at least one sample inlet, wherein the at least one sample inlet has at least one side that is parallel to another side of the at least one sample inlet and the at least one sample inlet has at least two rounded ends connecting each of the parallel sides, and each of the at least four guard inlets located separate from the at least one sample inlet has at least one side that is parallel to another side of each guard inlet and each guard inlet at least two rounded ends connecting each of the parallel sides.

In another embodiment, a packer is disclosed, having a mandrel configured to move from a first unactuated position to a second actuated position, a body configured to expand from an unactuated position to a second expanded position, the expanded position occurring through actuation of the mandrel, at least one covering over the body, the covering with inlets having at least one sample inlet and at least two guard inlets located separate from the at least one sample inlet around the periphery of the at least one sample inlet, wherein the at least one sample inlet has at least one side that is parallel to another side of the at least one sample inlet and the at least one sample inlet has at least two rounded ends connecting each of the parallel sides, and each of the at least two guard inlets located separate from the at least one sample inlet has at least one side that is parallel to another side of each guard inlet and each guard inlet at least two rounded ends connecting each of the parallel sides.

DETAILED DESCRIPTION

Figure 5:
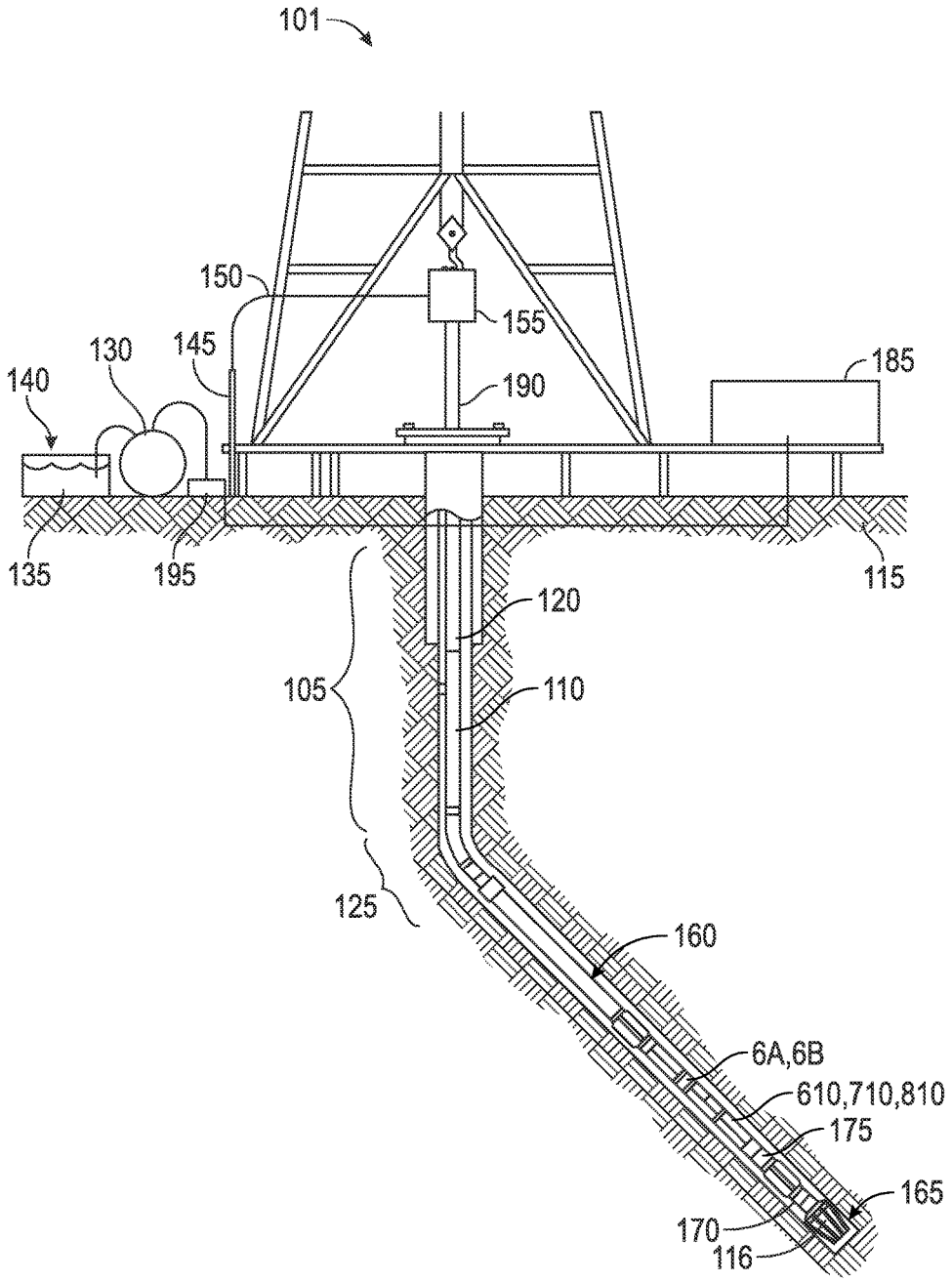
FIG. 5 is a side elevation section of drilling rig, wherein the single packer described may be used.

Referring to FIG. 5, an example well site system is schematically depicted wherein components described above are incorporated in the larger systems described therein. The well site comprises a well. Single packer systems may be used "while drilling" or on a wireline. First, an example well site system is described. A drill string 105 may extend from the drill rig 101 into a zone of the formation of reservoir 115. The drill string 105 employs a telemetry system for transmitting data from downhole to the surface. In the illustrated embodiment, the telemetry system is a mud pulse telemetry system.

Although illustrated with a mud pulse telemetry, the drill string 105 may employ any type of telemetry system or any combination of telemetry systems, such as electromagnetic, acoustic and\or wired drill pipe, however in the preferred embodiment, only the mud pulse telemetry system is used. A bottom hole assembly ("BHA") is suspended at the end of the drill string 105. In an embodiment, the bottom hole assembly comprises a plurality of measurement while drilling or logging while drilling downhole tools 125, such as shown by numerals 6*a* and 6*b*. For example, one or more of the downhole tools 6*a* and 6*b* may be a formation pressure while drilling tool.

Logging while drilling ("LWD") tools used at the end of the drill string 105 may include a thick walled housing, commonly referred to as a drill collar, and may include one or more of a number of logging devices. The logging while drilling tool may be capable of measuring, processing, and/or storing information therein, as well as communicating with equipment disposed at the surface of the well site.

Measurement while drilling ("MWD") tools may include one or more of the following measuring tools: a modulator, a weight on bit measuring device, a torque measuring device, a vibration measuring device, a shock measuring device, a stick slip measuring device, a direction measuring device, and inclination measuring device, and\or any other device.

Measuring made by the bottom hole assembly or other tools and sensors with the drill string 105 may be transmitted to a computing system 185 for analysis. For example, mud pulses may be used to broadcast formation measurements performed by one or more of the downhole tools 6*a* and 6*b* to the computing system 185.

The computing system 185 is configured to host a plurality of models, such as a reservoir model, and to acquire and process data from downhole components, as well as determine the bottom hole location in the reservoir 115 from measurement while drilling data. Examples of reservoir models and cross well interference testing may be found in the following references: "Interpreting an RFT-Measured Pulse Test with a Three-Dimensional Simulator" by Lasseter, T., Karakas, M., and Schweitzer, J., SPE 14878, March 1988. "Design, Implementation, and Interpretation of a Three-Dimensional Well Test in the Cormorant Field, North Sea" by Bunn, G. F., and Yaxley, L. M., SPE 15858, October 1986. "Layer Pulse Testing Using a Wireline Formation Tester" by Saeedi, J., and Standen, E., SPE 16803, September 1987. "Distributed Pressure Measurements Allow Early Quantification of Reservoir Dynamics in the Jene Field" by Bunn, G. F., Wittman, M. J., Morgan, W. D., and Curnutt, R. C., SPE 17682, March 1991. "A Field Example of Interference Testing Across a Partially Communicating Fault" by Yaxley, L. M., and Blaymires, J. M., SPE 19306, 1989. "Interpretation of a Pulse Test in a Layered Reservoir" by Kaneda, R., Saeedi, J., and Ayestaran, L. C., SPE 19306, December 1991.

The drill rig 101 or similar looking/functioning device may be used to move the drill string 105 within the well that is being drilled through subterranean formations of the reservoir, generally at 115. The drill string 105 may be extended into the subterranean formations with a number of coupled drill pipes (one of which is designated 120) of the drill string 105. The drill pipe 120 comprising the drill string 105 may be structurally similar to ordinary drill pipes, as illustrated for example and U.S. Pat. No. 6,174,001, issued to Enderle, entitled "Two-Step, a Low Torque, Wedge Thread for Tubular Connector," issued Aug. 7, 2001, which is incorporated herein by reference in its entirety, and may include a cable associated with each drill pipe 120 that serves as a communication channel.

The bottom hole assembly at the lower end of the drill string 105 may include one, an assembly, or a string of downhole tools. In the illustrated example, the downhole tool string 105 may include well logging tools 125 coupled to a lower end thereof. As used in the present description, the term well logging tool or a string of such tools, may include at least one or more logging while drilling tools ("LWD"), formation evaluation tools, formation sampling tools and other tools capable of measuring a characteristic of the subterranean formations of the reservoir 115 and\or of the well.

Several of the components disposed proximate to the drill rig 101 may be used to operate components of the overall system. These components will be explained with respect to their uses in drilling the well 110 for a better understanding thereof. The drill string 105 may be used to turn and urge a drill bit 116 into the bottom the well 110 to increase its length (depth). During drilling of the well 110, a pump 130 lifts drilling fluid (mud) 135 from a tank 140 or pits and discharges the mud 135 under pressure through a standpipe 145 and flexible conduit 150 or hose, through a top drive 155 and into an interior passage inside the drill pipe 105. The mud 135 which can be water or oil-based, exits the drill pipe 105 through courses or nozzles (not shown separately) in the drill bit 116, wherein it cools and lubricates the drill bit 116 and lifts drill cuttings generated by the drill bit 116 to the surface of the earth through an annular arrangement.

When the well 110 has been drilled to a selected depth, the well logging tools 125 may be positioned at the lower end of the pipe 105 if not previously installed. The well logging tools 125 may be positioned by pumping the well logging downhole tools 125 down the pipe 105 or otherwise moving the well logging downhole tools 125 down the pipe 105 while the pipe 105 is within the well 110. The well logging tools 125 may then be coupled to an adapter sub 160 at the end of the drill string 105 and may be moved through, for example in the illustrated embodiment, a highly inclined portion 165 of the well 110, which would be inaccessible using armored electrical cable to move the well logging downhole tools 125.

During well logging operations, the pump 130 may be operated to provide fluid flow to operate one or more turbines in the well logging downhole tools 125 to provide power to operate certain devices in the well logging tools 125. When tripping in or out of the well 110, (turning on and off the mud pumps 130) it may be in feasible to provide fluid flow. As a result, power may be provided to the well logging tools 125 in other ways. For example, batteries may be used to provide power to the well logging downhole tools 125. In one embodiment, the batteries may be rechargeable batteries and may be recharged by turbines during fluid flow. The batteries may be positioned within the housing of one or more of the well logging tools 125. Other manners of powering the well logging tools 125 may be used including, but not limited to, one-time power use batteries.

As the well logging tools 125 are moved along the well 110 by moving the drill pipe 105, signals may be detected by various devices, of which non-limiting examples may include a resistivity measurement device, a bulk density measurement device, a porosity measurement device, a formation capture cross-section measurement device 170, a gamma ray measurement device 175 and a formation fluid sampling tool 610, 710, 810 which may include a formation pressure measurement device 6*a* and/or 6*b*. The signals may be transmitted toward the surface of the earth along the drill string 105.

An apparatus and system for communicating from the drill pipe 105 to the surface computer 185 or other component configured to receive, analyze, and/or transmit data may include a second adapter sub 190 that may be coupled between an end of the drill string 105 and the top drive 155 that may be used to provide a communication channel with a receiving unit 195 for signals received from the well logging downhole tools 125. The receiving unit 195 may be coupled to the surface computer 185 to provide a data path therebetween that may be a bidirectional data path.

Though not shown, the drill string 105 may alternatively be connected to a rotary table, via a Kelly, and may suspend from a traveling block or hook, and additionally a rotary swivel. The rotary swivel may be suspended from the drilling rig 101 through the hook, and the Kelly may be connected to the rotary swivel such that the Kelly may rotate with respect to the rotary swivel. The Kelly may be any mast that has a set of polygonal connections or splines on the outer surface type that mate to a Kelly bushing such that actuation of the rotary table may rotate the Kelly.

An upper end of the drill string 105 may be connected to the Kelly, such as by threadingly reconnecting the drill string 105 to the Kelly, and the rotary table may rotate the Kelly, thereby rotating the drill string 105 connected thereto.

Although not shown, the drill string 105 may include one or more stabilizing collars. A stabilizing collar may be disposed within or connected to the drill string 105, in which the stabilizing collar may be used to engage and apply a force against the wall of the well 110. This may enable the stabilizing collar to prevent the drill pipe string 105 from deviating from the desired direction for the well 110. For example, during drilling, the drill string 105 may "wobble" within the well 110, thereby allowing the drill string 105 to deviate from the desired direction of the well 110. This wobble action may also be detrimental to the drill string 105, components disposed therein, and the drill bit 116 connected thereto. A stabilizing collar may be used to minimize, if not overcome altogether, the wobble action of the drill string 105, thereby possibly increasing the efficiency of the drilling performed at the well site and/or increasing the overall life of the components at the wellsite.

Figures 1A, 1B, 1C:
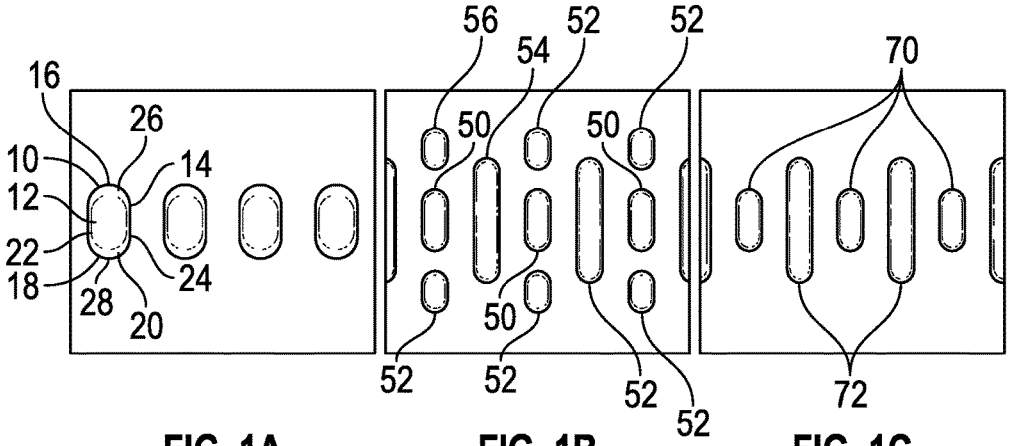
FIG. 1A is a first example embodiment of an inlet geometry according to one aspect described.
FIG. 1B is a second example embodiment of an inlet geometry according to a second aspect described.
FIG. 1C is a third example embodiment of an inlet geometry according to a third aspect described.

Referring to FIG. 1A, a first example embodiment of an inlet design for a single packer. In the example embodiment, a sample inlet 10 is placed such that fluid (in the form of gas, liquid or combination of gas and liquid, may enter the body of a single packer. The sample inlet has a first side 12 that is parallel to a second side 14. Connecting the first side 12 to the second side 14 is a first end 16 and a second end 18. Both the first end and the second ends are half circular sections.

A guard inlet 20 surrounds the sample inlet 10. The guard inlet has a first side 22 that is parallel to a second side 24. Connecting the first side 22 to the second side 24 is a first end 26 and a second end 28.

In the first embodiment, the sample inlet 10 may be chosen as any size. The corresponding guard inlet 20 may be appropriately sized to surround the sample inlet 10.

A second embodiment of guard and sample inlets is provided in FIG. 1B. In this embodiment, three sample inlets 50 are provided. More or less sample inlets may be provided, based upon the circumference of the single packer. Guard inlets 52 are provided around the periphery of the sample inlets 50, as illustrated. In this illustrated embodiment, the sizes of respective guard inlets 52 are varied. As an example, guard inlets noted as 54 have elongated parallel sides resulting in an overall longer inlet design. Alternate guard inlets 54 are configured with reduced length parallel sides, thereby reducing the overall lengths of these respective inlets.

Referring to FIG. 1C, a third example embodiment of guard and sample inlets is illustrated. Sample inlets 70 are provided for sampling fluids into the body of the single packer system. In the illustrated example, the sample inlets 70 are placed in between guard inlets 72. The guard inlets 72 have elongated parallel sides compared to the sample inlets 70, thereby increasing the overall length of the guard inlets 72.

Each of the embodiments provided in FIG. 1A, FIG. 1B and FIG. 1C provide a configuration where both a sample and a guard inlet are provided. In these embodiments the sample obtained from the sample inlets may be stored in packer itself, transported to a sample bottle for storage or transported to the surface. For guard inlets, the fluid obtained may be pumped back to the downhole environment, in a non-limiting embodiment.

Figure 2:
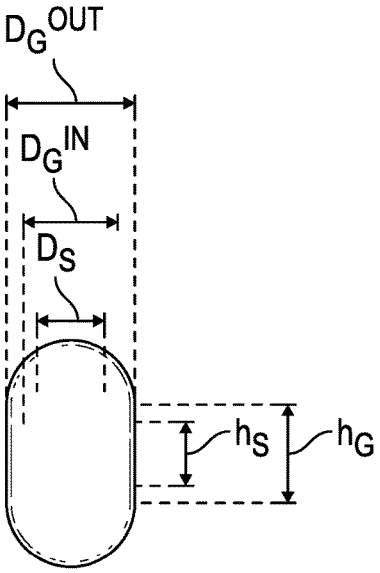
FIG. 2 is an alternative example embodiment of an inlet geometry with guard inlet and sample inlet.

Referring to FIG. 2, an enlarged view of the inlets of FIG. 1A is illustrated. The respective guard inlet and sample inlet features are provided. The outer diameter of the guard inlet is noted as $D_G$ out and the inner diameter of the guard inlet is noted as $D_G$ in. The outer diameter of the sample inlet is noted as $D_s$. The length of the parallel sides of the sample inlet is noted as $h_s$ and the length of the guard inlet parallel sides is noted as $h_G$.

Figures 3A, 3B:
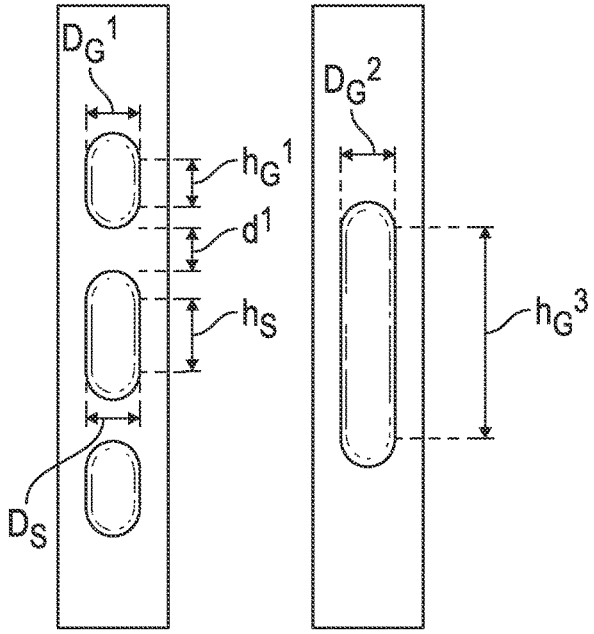
FIG. 3A is another example design of a first slat for an another alternative single packer configuration.
FIG. 3B is another example design of a second slat for the alternative single packer configuration used in conjunction with FIG. 4A.

Referring to FIG. 3A and FIG. 3B, the guard and sample inlets of FIG. 1B are illustrated in more detail. In this embodiment, the outer diameter of the sample inlet is noted as $D_s$ and the length of a parallel side of the sample inlet is noted as $h_s$. The outer diameter of the guard inlet in FIG. 3A is noted as $D_G^1$ and the length of a parallel side of the guard inlet is noted as $h_G^1$. The space between the guard inlet and the sample inlet is noted as $d^1$. For the elongated guard inlet of FIG. 3B, the overall length of a parallel side if noted as $h_G^1$ and the diameter of the guard inlet is noted as $D_G^1$.

Figures 4A, 4B:
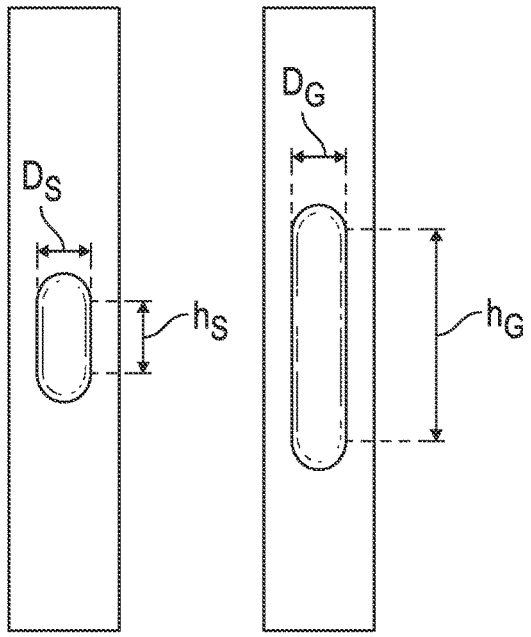
FIG. 4A is another example design of a first slat of a differing alternative single packer configuration.
FIG. 4B is another example design of a second slat of a differing alternative single packer configuration.

Referring to FIG. 4A and FIG. 4B, the guard and sample inlets of FIG. 1C are illustrated in more detail. In this embodiment, the outer diameter of the sample inlet is noted as $D_s$ and the length of a parallel side of the sample inlet is noted as $h_s$. The outer diameter of the guard inlet in FIG. 3A is noted as $D_G$ and the length of a parallel side of the guard inlet is noted as $h_G$.

In the embodiment provided in FIG. 4A and FIG. 4B, the straight sides of the guard inlet and the sample inlet are essentially parallel. The non-straight sides of the guard inlet and the sample inlet are semi-circular.

In each of the embodiments provided, the sample and guard inlets may accept fluid from the downhole environment through actuation of a suction force. In the instant cases, such force is provided by a downhole pump. The downhole pump may be provided with electrical power from a surface location or may be actuated through power provided downhole through a mud turbine or through a connected battery.

The outer covering of the packer may be made of materials that allow for expansion and contraction of the packer. The surface of packer may be made of rubber, in a non-limiting embodiment, to allow the packer to seal against rough and uneven surfaces. The outer covering has a configuration wherein the covering will allow for a pressure retaining capability.

The packer may be actuated through use of a mandrel that may be located within the body of the packer. The mandrel may be electrically or hydraulically actuated. The body of the packer may contain various inlets for sampling fluids from the downhole environment. The inlets may accept the fluid samples and transfer the fluid through a series of tubes that swivel.

A method of operation of a typical packer may be accomplished through the following parameters:

1) A wellbore may be drilled as described above. In the illustrated embodiment, the drilling of well is performed in a hydrocarbon bearing stratum that has been determined to contain hydrocarbon fluids. The wellbore may be a vertical well or may be deviated from vertical, at the direction of drillers.
2) After drilling to the desired depth, operators may require the formation to be tested to determine the presence of hydrocarbons.
3) Placement of a packer device may be accomplished next. The placement is done with accuracy on a wireline, as a non-limiting example. In other embodiments, the packer may be a component in a bottom hole assembly.
4) Next, the packer device may be actuated so that the outer diameter of the single packer is expanded so that the outer surface of the packer abuts a surface from which sampling is desired.
5) After sealing the packer device to the formation, pumping operations may start wherein fluid from the formation, for example, is taken through a guard inlet.
6) Next, the operator may either pump from the guard inlet for a predetermined amount of time or the fluid flow may be pumped and monitored for contamination levels to fall below a threshold amount.
7) Once pumping from the guard flow has stabilized through either the satisfaction of the predetermined amount of time pumping or if contamination levels have fallen below a threshold amount, pumping from the sample inlet begins.
8) The required amount of sample if obtained from the sample inlet. The sample may be transported uphole, stored in the packer, or may be placed into sample bottles.

Variations from the above method may be accomplished and the above-identified method may be varied. One such variation may be to terminate guard flow pumping when sample pumping begins.

While the aspects have been described with respect to a limited number of embodiments, those skilled in the art, having benefit of the disclosure, will appreciate that other embodiments can be devised which do not depart from the scope of the disclosure herein.

What is claimed is:

1. A configuration for testing fluid with a single packer, comprising:

at least one sample inlet; and a plurality of guard inlets located separate from and positioned circumferentially around a periphery of the at least one sample inlet, wherein the at least one sample inlet has a first side, a second side that is parallel to the first side, at least two rounded ends connecting each of the parallel sides, wherein each guard inlet of the plurality of guard inlets has a third side, a fourth side that is parallel to the third side, and at least two rounded ends connecting each of the parallel sides; wherein at least two guard inlets of the plurality of guard inlets are disposed along a longitudinal axis of the at least one sample inlet and are aligned with the at least one sample inlet along the longitudinal axis, and wherein at least one guard inlet of the plurality of guard inlets is laterally aligned with the at least one sample inlet along an axis that is perpendicular to the longitudinal axis such that the third side or fourth side of a respective guard inlet of the plurality of guard inlets is positioned adjacent to the first side or the second side, respectively, of the at least one sample inlet.

2. A configuration for testing fluid with a single packer, comprising:

at least one sample inlet; and at least two guard inlets located separate from the at least one sample inlet around a periphery of the at least one sample inlet, wherein the at least one sample inlet has a first side, a second side that is parallel to the first side, and at least two rounded ends connecting each of the parallel sides, each guard inlet of the at least two guard inlets has a third side, a fourth side that is parallel to the third side, at least two rounded ends connecting each of the parallel sides; wherein each guard inlet of the at least two guard inlets is laterally aligned with the at least one sample inlet along an axis that is perpendicular to a longitudinal axis of the at least one sample inlet, wherein each guard inlet of the at least two guard inlets is positioned between adjacent sample inlets such that the third side of each respective guard inlet of the at least two guard inlets is positioned adjacent to the first side of a sample inlet of the adjacent sample inlets and the fourth side of the respective guard inlet of the at least two guard inlets is positioned adjacent to the second side of another sample inlet of the adjacent sample inlets.

3. A packer, comprising:

a mandrel configured to move from an unactuated position to an actuated position, a body configured to expand from an unexpanded position to an expanded position, the expanded position occurring through actuation of the mandrel;

at least one covering over the body, the covering comprising inlets having at least one sample inlet; and a plurality of guard inlets located separate from and positioned circumferentially around a periphery of the at least one sample inlet, wherein the at least one sample inlet has a first side, a second side that is parallel to the first side, and at least two rounded ends connecting each of the parallel sides, each guard inlet of the plurality of guard inlets has a third side, a fourth side that is parallel to the third side, at least two rounded ends connecting each of the parallel sides; wherein at least two guard inlets of the plurality of guard inlets are disposed along a longitudinal axis of the at least one sample inlet and are aligned with the at least one sample inlet along the longitudinal axis, and wherein at least one guard inlet of the plurality of guard inlets is laterally aligned with the at least one sample inlet along an axis that is perpendicular to the longitudinal axis such that the respective third side or fourth side of the at least one guard inlet of the plurality of guard inlets is positioned adjacent to the first side or the second side, respectively, of the at least one sample inlet.

4. A packer, comprising:

a mandrel configured to move from an unactuated position to an actuated position, a body configured to expand from an unexpanded position to an expanded position, the expanded position occurring through actuation of the mandrel;

at least one covering over the body, the covering comprising inlets having at least one sample inlet; and at least two guard inlets located separate from and positioned around a periphery of the at least one sample inlet, wherein the at least one sample inlet has a first side, a second side that is parallel to the first side, and at least two rounded ends connecting each of the parallel sides, each guard inlet of the at least two guard inlets has a third side, a fourth side that is parallel to third side, at least two rounded ends connecting each of the parallel sides; wherein each guard inlet of the at least two guard inlets is laterally aligned with the at least one sample inlet along an axis that is perpendicular to a longitudinal axis of the at least one sample inlet, and wherein each guard inlet is positioned between adjacent sample inlets such that the third side of each respective guard inlet of the at least two guard inlets is positioned adjacent to the first side of a sample inlet of the adjacent sample inlets and the fourth side of each respective guard inlet of the at least two guard inlets is positioned adjacent to the second side of another sample inlet of the adjacent sample inlets.

* * * * *